US011041473B2

(12) United States Patent
Okubo

(10) Patent No.: US 11,041,473 B2
(45) Date of Patent: Jun. 22, 2021

(54) CONTROL DEVICE AND CONTROL METHOD FOR ONBOARD INTERNAL COMBUSTION ENGINE

(71) Applicant: TOYOTA JIDOSHA KABUSHIKI KAISHA, Toyota (JP)

(72) Inventor: Takuya Okubo, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 16/786,120

(22) Filed: Feb. 10, 2020

(65) Prior Publication Data

US 2020/0263650 A1 Aug. 20, 2020

(30) Foreign Application Priority Data

Feb. 18, 2019 (JP) ..... JP2019-026340
Nov. 8, 2019 (JP) ..... JP2019-202995

(51) Int. Cl.

*F02N 11/08* (2006.01)
*F02D 41/04* (2006.01)
*F02D 41/08* (2006.01)
*F02D 41/12* (2006.01)
(Continued)

(52) U.S. Cl.

CPC ..... *F02N 11/0814* (2013.01); *F02D 41/0235* (2013.01); *F02D 41/045* (2013.01); *F02D 41/08* (2013.01); *F02D 41/123* (2013.01); *F02D 41/3005* (2013.01); *F05D 2220/40* (2013.01); *F05D 2260/99* (2013.01)

(58) Field of Classification Search

CPC .... F02N 11/0814; F02D 41/045; F02D 41/08; F02D 41/123; F02D 41/3005; F02D 41/0235; F02D 41/064; F02D 13/0249; F02D 37/02; F02D 41/0295; F02D 41/0007; F02D 41/1475; F02D 41/065; F02D 41/1454; F02D 2041/001; F05D 2260/99; F05D 2220/40; F02B 37/186; F02B 37/183

See application file for complete search history.

(56) References Cited

U.S. PATENT DOCUMENTS

2014/0137552 A1* 5/2014 Yokono ..... F02D 41/0007 60/600
2018/0245507 A1* 8/2018 Kitaura ..... F02B 37/183
2020/0180630 A1* 6/2020 Kaneko ..... B60W 30/18072

FOREIGN PATENT DOCUMENTS

JP 2012-036849 2/2012
JP 2014-088867 5/2014
(Continued)

*Primary Examiner* — Xiao En Mo
(74) *Attorney, Agent, or Firm* — Finnegan, Henderson, Farabow, Garrett & Dunner, LLP

(57) ABSTRACT

A control device includes an injection control unit, an ignition control unit, an idling stop control unit, and a boost control unit. The injection control unit executes a rich reduction control that makes an air-fuel ratio richer than a stoichiometric air-fuel ratio when the engine operation has been resumed by resuming supply of fuel to a combustion chamber. Further, the boost control unit is configured to execute a valve-closing keeping control that keeps a wastegate closed until a condition for cancelling the valve-closing keeping control has been satisfied by the engine operation that was performed after closing the wastegate during execution of a fuel cut-off control.

12 Claims, 7 Drawing Sheets

(51) Int. Cl.
*F02D 41/30* (2006.01)
*F02D 41/02* (2006.01)

(56) References Cited

FOREIGN PATENT DOCUMENTS

| | | |
|---|---|---|
| JP | 6132092 | 4/2017 |
| JP | 2018-135872 | 8/2018 |

* cited by examiner

CONTROL DEVICE AND CONTROL METHOD FOR ONBOARD INTERNAL COMBUSTION ENGINE

BACKGROUND

1. Field

The following description relates to a control device and a control method for an onboard internal combustion engine.

2. Description of Related Art

Japanese Laid-Open Patent Publication No. 2012-036849 discloses a control device that controls an onboard internal combustion engine that executes an idling stop control. The idling stop control automatically stops and restarts the internal combustion engine to discontinue idling operation. In a vehicle where the idling stop control is executed, while the internal combustion engine is not operating, oxygen is absorbed by a catalyst device. Thus, immediately after restarting, oxygen is excessively absorbed by the catalyst device. This reduces the ability to purify exhaust gas. Accordingly, the control device described in Japanese Laid-Open Patent Publication No. 2012-036849 executes a rich reduction control to reduce oxygen absorbed in the catalyst device at the restarting time. In the rich reduction control, a fuel injection amount is increased such that the air-fuel ratio becomes richer than the stoichiometric air-fuel ratio. This introduces exhaust gas containing excessive fuel into the catalyst device.

To restore the ability to purify exhaust gas through the rich reduction control, it is desired that the reduction of oxygen be completed immediately to quickly restore the purification ability.

SUMMARY

It is an object of the present disclosure to provide a control device and a control method for an onboard internal combustion engine capable of immediately completing the reduction of excessive oxygen at a restarting time and quickly restoring the purification ability by expediting a reduction reaction in a catalyst device.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To solve the above-described problem, according to a first aspect of the present disclosure, a control device for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control device includes an injection control unit that controls the fuel injection valve and performs a fuel cut-off control to stop supply of fuel to a combustion chamber during deceleration, an ignition control unit that controls the ignition device, an idling stop control unit that executes an idling stop control to discontinue idling operation by automatically stopping and restarting engine operation, and a boost control unit that controls opening and closing of the wastegate. The injection control unit is configured to execute a rich reduction control that makes an air-fuel ratio richer than a stoichiometric air-fuel ratio when the engine operation has been resumed by resuming the supply of the fuel to the combustion chamber. The boost control unit is configured to execute a valve-closing keeping control that keeps the wastegate closed until a condition for cancelling the valve-closing keeping control has been satisfied by the engine operation that was performed after closing the wastegate during execution of the fuel cut-off control.

To solve the above-described problem, according to a second aspect of the present disclosure, a control device for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control device includes circuitry that includes an injection control unit that controls the fuel injection valve and performs a fuel cut-off control to stop supply of fuel to a combustion chamber during deceleration, an ignition control unit that controls the ignition device, an idling stop control unit that executes an idling stop control to discontinue idling operation by automatically stopping and restarting engine operation, and a boost control unit that controls opening and closing of the wastegate. The injection control unit is configured to execute a rich reduction control that makes an air-fuel ratio richer than a stoichiometric air-fuel ratio when the engine operation has been resumed by resuming the supply of the fuel to the combustion chamber. The boost control unit is configured to execute a valve-closing keeping control that keeps the wastegate closed until a condition for cancelling the valve-closing keeping control has been satisfied by the engine operation that was performed after closing the wastegate during execution of the fuel cut-off control.

To solve the above-described problem, according to a third aspect of the present disclosure, a control device for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control device includes an injection control unit that controls the fuel injection valve and performs a fuel cut-off control to stop supply of fuel to a combustion chamber during deceleration, an ignition control unit that controls the ignition device, an idling stop control unit that executes an idling stop control to discontinue idling operation by automatically stopping and restarting engine operation, and a boost control unit that controls opening and closing of the wastegate. The injection control unit is configured to execute a rich reduction control that makes an air-fuel ratio richer than a stoichiometric air-fuel ratio when the engine operation has been resumed by resuming the supply of the fuel to the combustion chamber. The boost control unit is configured to execute a valve-closing keeping control that keeps the wastegate closed until a condition for cancelling the valve-closing keeping control has been satisfied by the engine operation that was performed after closing the wastegate prior to execution of the fuel cut-off control when a condition for executing the fuel cut-off control was satisfied.

To solve the above-described problem, according to a fourth aspect of the present disclosure, a control device for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control device includes circuitry that includes an injection control unit that controls the fuel injection valve and performs a fuel cut-off control to stop supply of fuel to a combustion chamber during deceleration, an ignition control unit that controls the ignition device, an idling stop control unit that executes an idling stop control to discontinue idling operation by automatically stopping and restarting engine operation, and a boost control unit that controls opening and closing of the wastegate. The injection control unit is configured to execute a rich reduction control that makes an air-fuel ratio richer than a stoichiometric air-fuel ratio when the engine operation has been resumed by resuming the supply of the fuel to the combustion chamber. The boost control unit is configured to execute a valve-closing keeping control that keeps the wastegate closed until a condition for cancelling the valve-closing keeping control has been satisfied by the engine operation that was performed after closing the wastegate prior to execution of the fuel cut-off control when a condition for executing the fuel cut-off control was satisfied.

To solve the above-described problem, according to a fifth aspect of the present disclosure, a control method for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control method includes controlling the fuel injection valve and performing a fuel cut-off control to stop supply of fuel to a combustion chamber during deceleration, controlling the ignition device, executing an idling stop control to discontinue idling operation by automatically stopping and restarting engine operation, controlling opening and closing of the wastegate, executing a rich reduction control that makes an air-fuel ratio richer than a stoichiometric air-fuel ratio when the engine operation has been resumed by resuming the supply of the fuel to the combustion chamber, and executing a valve-closing keeping control that keeps the wastegate closed until a condition for cancelling the valve-closing keeping control has been satisfied by the engine operation that was performed after closing the wastegate during execution of the fuel cut-off control.

To solve the above-described problem, according to a sixth aspect of the present disclosure, a control method for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control method includes controlling the fuel injection valve and performing a fuel cut-off control to stop supply of fuel to a combustion chamber during deceleration, controlling the ignition device, executing an idling stop control to discontinue idling operation by automatically stopping and restarting engine operation, controlling opening and closing of the wastegate, executing a rich reduction control that makes an air-fuel ratio richer than a stoichiometric air-fuel ratio when the engine operation has been resumed by resuming the supply of the fuel to the combustion chamber, and executing a valve-closing keeping control that keeps the wastegate closed until a condition for cancelling the valve-closing keeping control has been satisfied by the engine operation that was performed after closing the wastegate prior to execution of the fuel cut-off control when a condition for executing the fuel cut-off control was satisfied.

To solve the above-described problem, according to a seventh aspect of the present disclosure, a control device for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control device includes an injection control unit that controls the fuel injection valve, an ignition control unit that controls the ignition device, an idling stop control unit that executes an idling stop control to discontinue idling operation by automatically stopping and restarting engine operation, and a boost control unit that controls opening and closing of the wastegate. The injection control unit is configured to execute a rich reduction control that makes an air-fuel ratio richer than a stoichiometric air-fuel ratio when the engine operation has been resumed by resuming the supply of the fuel to the combustion chamber. The boost control unit is configured to execute a valve-closing keeping control that closes the wastegate when the idling stop control unit stops the supply of the fuel or before the idling stop control unit stops the supply of the fuel in a case in which a condition for executing the idling stop control is satisfied and keeps the wastegate closed until a condition for cancelling the valve-closing keeping control has been satisfied by the restarted engine operation.

To solve the above-described problem, according to an eighth aspect of the present disclosure, a control device for an onboard internal combustion engine is provided. The onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas. The control device includes an injection control unit that controls the fuel injection valve and performs a fuel cut-off control to stop supply of fuel to a combustion chamber during deceleration, an ignition control unit that controls the ignition device, and a boost control unit that controls opening and closing of the wastegate. The injection control unit is configured to execute a rich reduction control that makes an air-fuel ratio richer than a stoichiometric air-fuel ratio when the engine operation has been resumed by resuming the supply of the fuel to the combustion chamber. The boost control unit is configured to execute a valve-closing keeping control that closes the wastegate during execution of the fuel cut-off control or prior to the execution of the fuel cut-off control when a condition for executing the fuel cut-off control is satisfied and keeps the wastegate closed until a condition for cancelling the valve-closing keeping control has been satisfied after the fuel cut-off control was ended to resume the supply of the fuel.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A control device 100 for an internal combustion engine 10, which is an onboard internal combustion engine, according to a first embodiment will now be described with reference to FIGS. 1 to 7.

Figure 1:
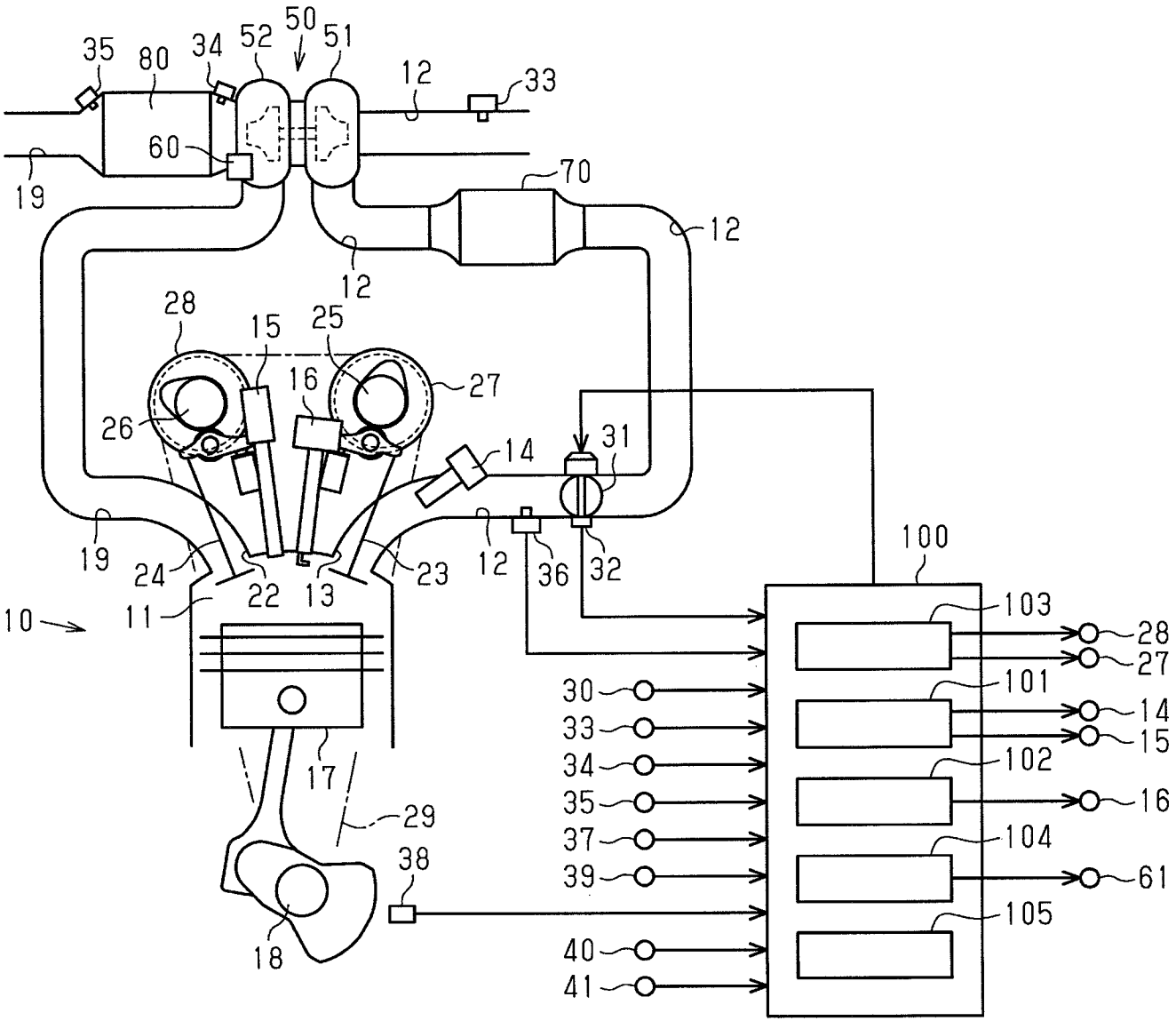
FIG. 1 is a diagram showing the configurations of a control device and an onboard internal combustion engine that is subject to control according to an embodiment of the present disclosure.

As shown in FIG. 1, the internal combustion engine 10, which is an onboard internal combustion engine, is equipped with a turbocharger 50, which includes a wastegate 60. The turbocharger 50 includes a compressor housing 51 and a turbine housing 52. The compressor housing 51 is arranged on an intake passage 12 of the internal combustion engine 10. The turbine housing 52 is arranged on an exhaust passage 19 of the internal combustion engine 10. The internal combustion engine 10 is controlled by the control device 100.

An air flow meter 33 is arranged at a portion of the intake passage 12 located upstream of the compressor housing 51. The air flow meter 33 detects an intake air amount and the temperature of intake air. An intercooler 70, a throttle valve 31, and an intake pressure sensor 36 are arranged in this order from the upstream side at portions of the intake passage 12 downstream of the compressor housing 51. The intercooler 70 cools intake air through heat exchange with coolant. The throttle valve 31 is driven by a motor to adjust the intake air amount.

Further, the internal combustion engine 10 includes a port injection valve 14, which is a fuel injection valve that injects fuel into intake air flowing through an intake port 13. The port injection valve 14 is arranged on the intake port 13, which is a portion that connects the intake passage 12 to a combustion chamber 11. In addition, the combustion chamber 11 includes a direct injection valve 15 and an ignition device 16. The direct injection valve 15 is a fuel injection valve that directly injects fuel into the combustion chamber 11. The ignition device 16 performs spark discharge to ignite the air-fuel mixture of air and fuel introduced into the combustion chamber 11. The combustion chamber 11 is connected to the exhaust passage 19 by an exhaust port 22.

The internal combustion engine 10 is an inline four-cylinder internal combustion engine and includes four combustion chambers 11. FIG. 1 shows only one of the four combustion chambers 11. When the air-fuel mixture burns in the combustion chamber 11, a piston 17 reciprocates to rotate a crankshaft 18, which is an output shaft of the internal combustion engine 10. The exhaust gas subsequent to being burned is discharged from the combustion chamber 11 to the exhaust passage 19.

The intake port 13 includes an intake valve 23. The exhaust port 22 includes an exhaust valve 24. The intake valve 23 is opened and closed by rotation of an intake camshaft 25, to which rotation of the crankshaft 18 is transmitted. The exhaust valve 24 is opened and closed by rotation of an exhaust camshaft 26, to which rotation of the crankshaft 18 is transmitted.

The intake camshaft 25 includes an intake-side variable valve timing mechanism 27. The intake-side variable valve timing mechanism 27 varies the phase of the intake camshaft 25 relative to the crankshaft 18 to vary the timing of opening and closing the intake valve 23. Further, the exhaust camshaft 26 includes an exhaust-side variable valve timing mechanism 28. The exhaust-side variable valve timing mechanism 28 varies the phase of the exhaust camshaft 26 relative to the crankshaft 18 to vary the timing of opening and closing the exhaust valve 24.

A timing chain 29 is wound around the intake-side variable valve timing mechanism 27, the exhaust-side variable valve timing mechanism 28, and the crankshaft 18. Thus, when rotation of the crankshaft 18 is transmitted by the timing chain 29, the intake camshaft 25 rotates together with the intake-side variable valve timing mechanism 27 and the exhaust camshaft 26 rotates together with the exhaust-side variable valve timing mechanism 28. A catalyst device 80 is arranged at a portion of the exhaust passage 19 located downstream of the turbine housing 52. The catalyst device 80 supports a three-way catalyst that reduces NOx and oxidizes CO and HC in exhaust gas at the same time. The catalyst device 80 has an oxygen absorption ability to absorb oxygen contained in the gas flowing through the exhaust passage 19.

Figure 2:
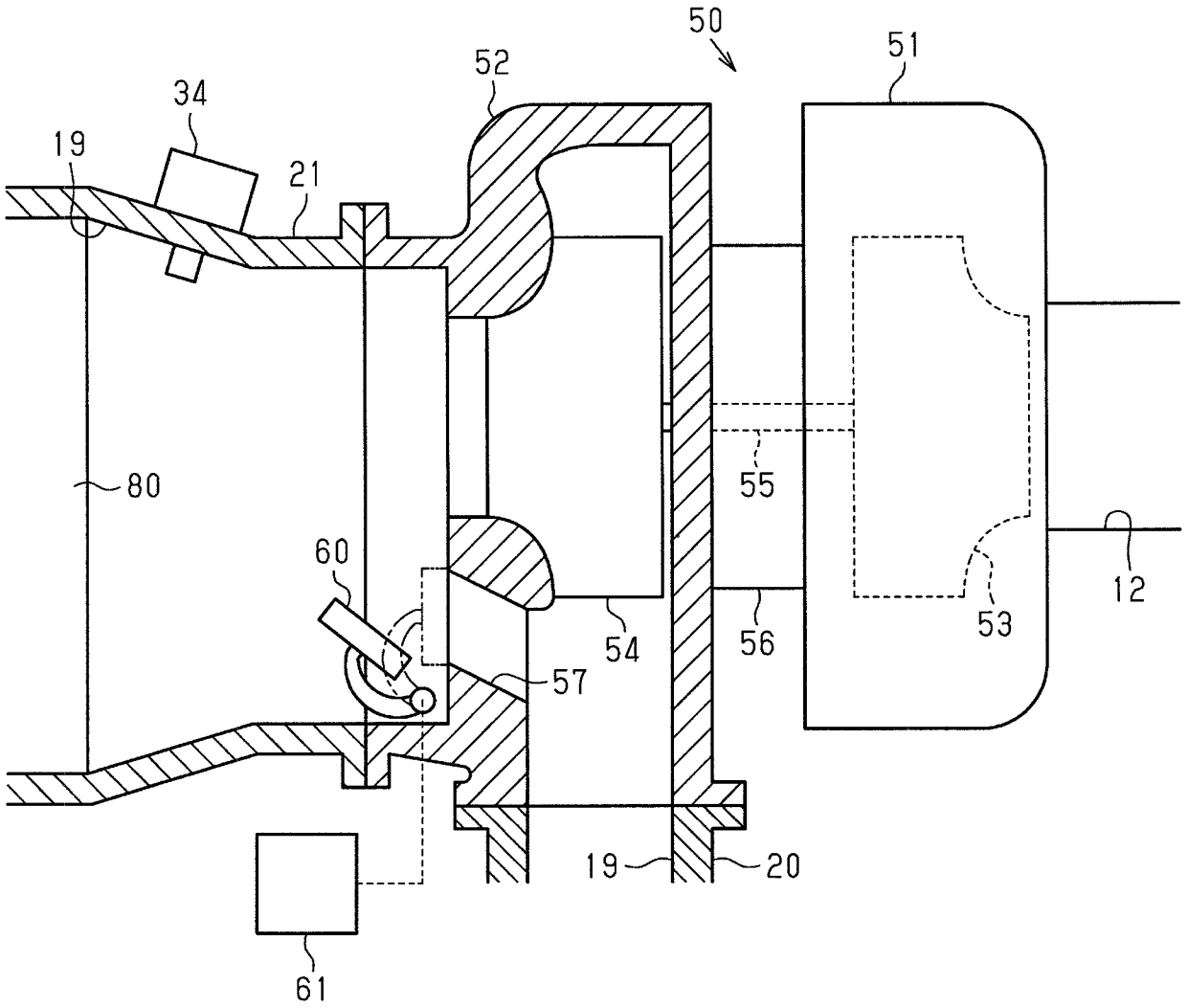
FIG. 2 is a cross-sectional view showing the turbine housing in the turbocharger.

As shown in FIG. 2, an upstream exhaust pipe 20 and a downstream exhaust pipe 21, which form the exhaust passage 19, are connected to the turbine housing 52. The turbine housing 52 accommodates a turbine wheel 54. The compressor housing 51 accommodates a compressor wheel 53. A bearing housing 56 accommodates a shaft 55. The turbine wheel 54 is coupled to the compressor wheel 53 by the shaft 55. The turbine wheel 54 is rotated by the stream of exhaust gas introduced into the turbine housing 52 through the upstream exhaust pipe 20. This rotates the compressor wheel 53 to compress intake air and then deliver the intake air to the combustion chamber 11.

The turbine housing 52 includes a wastegate port 57. Exhaust gas passes through the wastegate port 57 to bypass the turbine wheel 54 and flow toward the downstream side of the turbine wheel 54. The wastegate 60 opens and closes the outlet of the wastegate port 57 to control a boost pressure. That is, when the wastegate 60 is fully closed, the exhaust gas introduced into the turbine housing 52 through the upstream exhaust pipe 20 passes through the turbine wheel 54 and flows into the downstream exhaust pipe 21. In this case, the turbine wheel 54 and the compressor wheel 53 rotate to increase the boost pressure. When the wastegate 60 is open, the exhaust gas introduced into the turbine housing 52 through the upstream exhaust pipe 20 bypasses the turbine wheel 54, passes through the wastegate port 57, and flows into the downstream exhaust pipe 21. In this case, the boost pressure is low. The wastegate 60 is driven by an actuator 61. The actuator 61 may be an electric motor or a device that is actuated using air pressure or hydraulic pressure.

As shown in FIG. 1, an upstream A/F sensor 34 is arranged on a portion of the exhaust passage 19 between the turbine housing 52 and the catalyst device 80. The upstream A/F sensor 34 is a sensor that outputs a detection value corresponding to the oxygen concentration of gas flowing through the exhaust passage 19, that is, an air-fuel ratio sensor that detects the air-fuel ratio of air-fuel mixture. Further, a downstream A/F sensor 35 is arranged on a portion of the exhaust passage 19 located downstream of the catalyst device 80. The downstream A/F sensor 35 is an air-fuel ratio sensor in the same manner as the upstream A/F sensor 34.

The control device 100 controls the internal combustion engine 10 by operating various devices subject to operation such as the throttle valve 31, the port injection valve 14, the direct injection valve 15, the ignition device 16, the intake-side variable valve timing mechanism 27, the exhaust-side variable valve timing mechanism 28, and the wastegate 60. A detection signal of the operation amount of an accelerator of a driver is input to the control device 100 by an accelerator position sensor 30. Further, a detection signal of a vehicle speed, which is a traveling speed of the vehicle, is input to the control device 100 by a vehicle speed, sensor 41.

Furthermore, in addition to the air flow meter 33, the upstream A/F sensor 34, the downstream A/F sensor 35, and the intake pressure sensor 36, detection signals of various sensors are input to the control device 100. For example, a throttle position sensor 32 detects an open degree of the throttle valve 31. A crank position sensor 38 detects a rotation phase of the crankshaft 18. A water temperature sensor 37 detects a coolant temperature, which is the temperature of coolant in the internal combustion engine 10. From a detection signal of the crank position sensor 38, the control device 100 calculates an engine rotation speed, which is a rotation speed of the crankshaft 18 of the internal combustion engine 10. An intake-side cam position sensor 39 detects a rotation phase of the intake camshaft 25. From a detection signal of the intake-side cam position sensor 39 and a detection signal of the crank position sensor 38, the control device 100 calculates the phase of the intake camshaft 25 relative to the crankshaft 18, which indicates the timing of opening and closing the intake valve 23. An exhaust-side cam position sensor 40 detects a rotation phase of the exhaust camshaft 26. From a detection signal of the exhaust-side cam position sensor 40 and a detection signal of the crank position sensor 38, the control device 100 calculates the phase of the exhaust camshaft 26 relative to the crankshaft 18, which indicates the timing of opening and closing the exhaust valve 24.

The control device 100 receives output signals of various sensors and also performs various types of calculation based on these output signals. Further, the control device 100 executes various types of control for engine operation in accordance with the calculation results. The control device 100 includes, as control units that perform various types of control, an injection control unit 101, an ignition control unit 102, and a valve timing control unit 103. The injection control unit 101 controls the port injection valve 14 and the direct injection valve 15. The ignition control unit 102 controls the ignition device 16. The valve timing control unit 103 controls the intake-side variable valve timing mechanism 27 and the exhaust-side variable valve timing mechanism 28. Further, the control device 100 includes a boost control unit 104 and an idling stop control unit 105. The boost control unit 104 controls the wastegate 60 by driving the actuator 61. The idling stop control unit 105 executes an idling stop control, which discontinues idling operation, by automatically stopping and restarting the engine operation.

The injection control unit 101 calculates a target fuel injection amount, which is a control target value for the fuel injection amount, based on, for example, the operation amount of the accelerator, the vehicle speed, the intake air amount, the engine rotation speed, and an engine load factor. The engine load factor is the ratio of an inflow air amount per combustion cycle of a single cylinder to a reference inflow air amount. The reference inflow air amount is an inflow air amount per combustion cycle of a single cylinder when the open degree of the throttle valve 31 is the maximum. The reference inflow air amount is determined in accordance with the engine rotation speed. The injection control unit 101 basically calculates the target fuel injection amount such that the air-fuel ratio becomes the stoichiometric air-fuel ratio. Further, the injection control unit 101 calculates the control target values of the injection timings and fuel injection times of the port injection valve 14 and the direct injection valve 15. The port injection valve 14 and the direct injection valve 15 are driven to open in accordance with these control target values. This causes an amount of fuel corresponding to the operating state of the internal combustion engine 10 to be injected and supplied to the combustion chamber 11. In accordance with the operating state, the internal combustion engine 10 switches whether to inject fuel from the port injection valve 14 or the direct injection valve 15. Thus, in the internal combustion engine 10, in addition to injecting fuel both from the port injection valve 14 and the direct injection valve 15, fuel may be injected only from the port injection valve 14 or only from the direct injection valve 15. Additionally, the injection control unit 101 performs a fuel cut-off control in order to reduce a fuel consumption rate, for example, during deceleration in which the operation amount of the accelerator is zero. In the fuel cut-off control, the injection of fuel is stopped to hinder the supply of the fuel to the combustion chamber 11.

The ignition control unit 102 calculates an ignition timing, which is the timing of spark discharge performed by the ignition device 16, to operate the ignition device 16 and ignite the air-fuel mixture. The valve timing control unit 103 calculates the target value of the phase of the intake camshaft 25 relative to the crankshaft 18 and the target value of the phase of the exhaust camshaft 26 relative to the crankshaft 18 based on the engine rotation speed and the engine load factor to operate the intake-side variable valve timing mechanism 27 and the exhaust-side variable valve timing mechanism 28. This causes the valve timing control unit 103 to control the timing of opening and closing the intake valve 23 and the timing of opening and closing the exhaust valve 24. For example, the valve timing control unit 103 controls a valve overlap, which is a period during which the exhaust valve 24 and the intake valve 23 are both open.

The boost control unit 104 drives the actuator 61 to control the open degree of the wastegate 60 by calculating a target open degree of the wastegate 60, for example, based on the vehicle speed and the accelerator operation amount or based on the engine rotation speed and the engine load factor.

The idling stop control unit 105 outputs commands to the injection control unit 101 and the ignition control unit 102, to automatically stop the engine operation by stopping fuel supply and ignition while the vehicle is not operating and resume the engine operation by automatically resuming the fuel supply and ignition when the vehicle is started. That is, the idling stop control unit 105 executes the idling stop control, which discontinues idling operation, by automatically stopping and restarting the engine operation.

When the fuel cut-off control is executed to cause the vehicle to coast, air flows through the exhaust passage 19 into the catalyst device 80. When the vehicle stops and the engine operation is stopped by the idling stop control or the like, the catalyst device 80 remains exposed to air. As a result, the catalyst device 80 absorbs a huge amount of oxygen. Thus, when the internal combustion engine 10 is restarted, the absorption amount of oxygen in the catalyst device 80 is excessively large. This may reduce the ability to purify exhaust gas. Thus, in the control device 100, the injection control unit 101 executes a rich reduction control, which makes the air-fuel ratio richer than the stoichiometric air-fuel ratio, when the engine operation has been resumed by resuming the supply of fuel to the combustion chamber 11. The execution of the rich reduction control causes excess fuel and exhaust gas to be introduced into the catalyst device 80. Thus, when the oxygen absorbed by the catalyst device 80 reacts with fuel, the oxygen is reduced.

Figure 3:
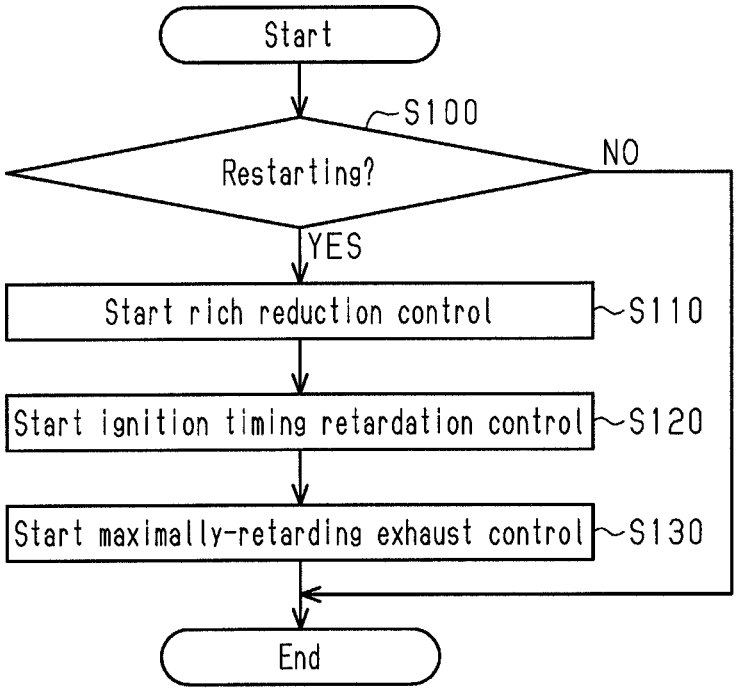
FIG. 3 is a flowchart illustrating the flow of processes in a routine for determining to start a rich reduction control.

Next, a series of processes for the rich reduction control will be described with reference to FIGS. 3 and 4. FIG. 3 illustrates the flow of the processes in a routine for determining to start the rich reduction control. This routine is repeatedly executed by the control device 100 while the control device 100 is running.

As shown in FIG. 3, when starting this routine, in the process of step S100, the control device 100 first determines whether the current time is the restarting time of the internal combustion engine 10 by the idling stop control. That is, the control device 100 determines whether the restarting is performed from a state in which the internal combustion engine 10 is automatically stopped by the idling stop control.

When determining that the current time is the restarting time by the idling stop control (step S100: YES), the control device 100 advances the process to step S110. In the process of step S110, the injection control unit 101 of the control device 100 starts the rich reduction control. In the rich reduction control, the injection control unit 101 makes the air-fuel ratio richer than when the rich reduction control is not executed, and injects fuel the amount of which is increased with respect to the target fuel injection amount such that the air-fuel ratio becomes richer than the stoichiometric air-fuel ratio.

Subsequently, in the process of step S120, the ignition control unit 102 of the control device 100 starts an ignition timing retardation control. In the ignition timing retardation control, the ignition control unit 102 corrects the ignition timing to be retarded than when the ignition timing retardation control is not executed, and performs spark discharge of the ignition device 16 at a timing that is more retarded than the ignition timing when the ignition timing retardation control is not executed.

In the process of step S130 subsequent to step S120, the valve timing control unit 103 of the control device 100 starts a maximally-retarding exhaust control. In the maximally-retarding exhaust control, the valve timing control unit 103 uses the exhaust-side variable valve timing mechanism 28 to set the timing of opening and closing the exhaust valve 24 to be most retarded. With the timing of opening and closing the exhaust valve 24 set to be most retarded, the valve overlap is controlled by adjusting the timing of opening and closing the intake valve 23 using the intake-side variable valve timing mechanism 27. That is, when executing the maximally-retarding exhaust control, the valve timing control unit 103 adjusts the timing of opening and closing the intake valve 23 with the timing of opening and closing the exhaust valve 24 set to be most retarded such that the same valve overlap can be achieved as when the maximally-retarding exhaust control is not executed. When starting the rich reduction control, the ignition timing retardation control, and the maximally-retarding exhaust control through the processes of step S110 to step S130, the control device 100 ends this routine.

Further, as shown in FIG. 3, when determining in the process of step S100 that the current time is not the restarting time by the idling stop control (step S100: NO), the control device 100 ends this routine without executing the processes of step S110 to step S130. That is, when the current time is not the restarting time by the idling stop control, the control device 100 does not execute the rich reduction control, the ignition timing retardation control, and the maximally-retarding exhaust control.

Figure 4:
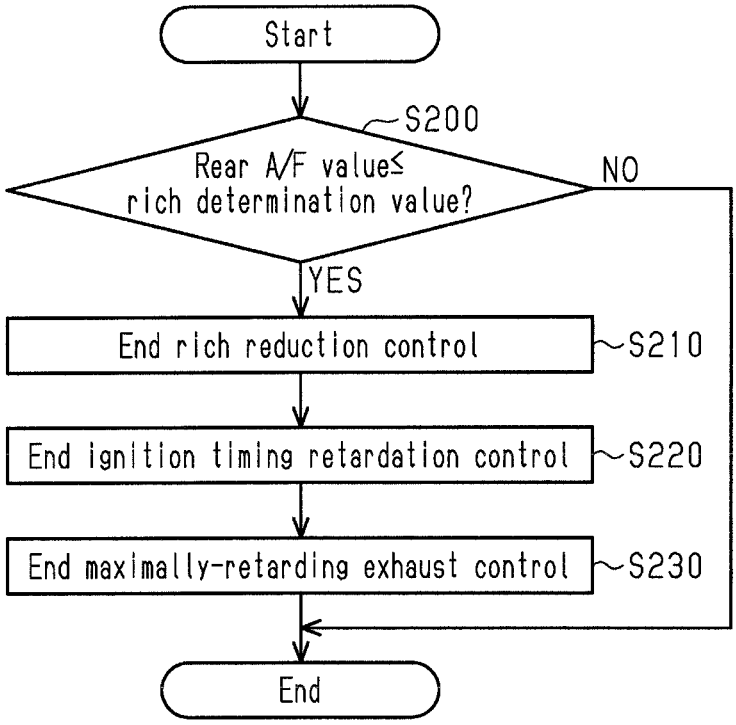
FIG. 4 is a flowchart illustrating the flow of processes in a routine for determining to end the rich reduction control.

FIG. 4 illustrates the flow of the processes in a routine for determining to end the rich reduction control. This routine is repeatedly executed by the control device 100 during the execution of the rich reduction control.

As shown in FIG. 4, when starting this routine, in the process of step S200, the control device 100 first determines whether a rear A/F value, which is a detection value of the downstream A/F sensor 35, is less than or equal to a rich determination value. The rich determination value is a threshold value for determining that unburned fuel is contained in the exhaust gas flowing downstream of the catalyst device 80 based on the rear A/F value being less than or equal to the rich determination value. That is, the rich determination value is set to a value that is slightly smaller than a value indicating that the rear A/F value is the stoichiometric air-fuel ratio (i.e., a value indicating being rich).

When determining that the rear A/F value is less than or equal to the rich determination value (step S200: YES), the control device 100 advances the process to step S210.

The control device 100 ends the rich reduction control in the process of step S210. In the process of step S210, the injection control unit 101 of the control device 100 ends the rich reduction control. This causes the injection control unit 101 to stop increasing the fuel injection amount by the rich reduction control and execute fuel injection corresponding to the target fuel injection amount.

Subsequently, in the process of step S220, the ignition control unit 102 of the control device 100 ends the ignition timing retardation control. This causes the ignition control unit 102 to stop correcting the ignition timing by the ignition timing retardation control to be retarded and performs spark discharge of the ignition device 16 at an ignition timing at which correction with the ignition timing retardation control is not implemented.

In the process of step S230 subsequent to step S220, the valve timing control unit 103 of the control device 100 ends the maximally-retarding exhaust control. This causes the valve timing control unit 103 to cancel the state in which the timing of opening and closing the exhaust valve 24 is set to be most retarded. Thus, the valve timing control unit 103 calculates the target value of the phase of the intake camshaft 25 relative to the crankshaft 18 and the target value of the phase of the exhaust camshaft 26 relative to the crankshaft 18 based on the engine rotation speed and the engine load factor to operate the intake-side variable valve timing mechanism 27 and the exhaust-side variable valve timing mechanism 28. That is, the valve timing control unit 103 controls the valve overlap by operating both the timing of opening and closing the exhaust valve 24 and the timing of opening and closing the intake valve 23.

When ending the rich reduction control, the ignition timing retardation control, and the maximally-retarding exhaust control through the processes of step S210 to step S230, the control device 100 ends this routine.

Further, as shown in FIG. 4, when determining in the process of step S200 that the rear A/F value is greater than the rich determination value (step S200: NO), the control device 100 ends this routine without executing the processes of step S210 to step S230.

More specifically, when it can be estimated that the rear A/F value is greater than the rich determination value and unburned fuel is not contained in the exhaust gas flowing downstream of the catalyst device 80 although the rich reduction control is being executed, the control device 100 does not end the rich reduction control, the ignition timing retardation control, and the maximally-retarding exhaust control. In short, in the control device 100, the injection control unit 101 continues the rich reduction control until the fuel passes through the catalyst device 80 and reaches the downstream A/F sensor 35 without being completely consumed through a reduction reaction in the catalyst device 80 as a result of reducing oxygen absorbed by the catalyst device 80 through the rich reduction control.

To restore the ability to purify exhaust gas through the rich reduction control, it is preferred that the reduction of oxygen be completed immediately in the catalyst device 80 to quickly restore the purification ability. Thus, the control device 100 executes a valve-closing keeping control, which keeps the wastegate 60 closed, in order to expedite the reduction of oxygen by the rich reduction control.

Figure 5:
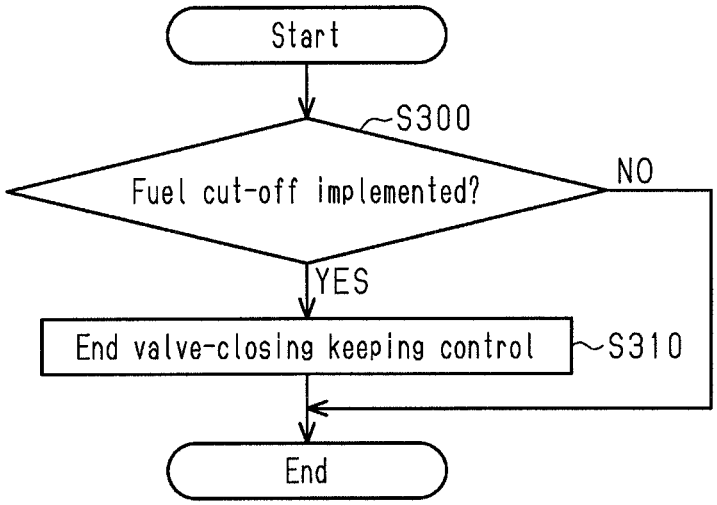
FIG. 5 is a flowchart illustrating the flow of processes in a routine for determining to start a valve-closing keeping control in a first embodiment.

Next, the valve-closing keeping control will be described with reference to FIGS. 5 and 6. FIG. 5 illustrates the flow of processes in a routine for determining to start the valve-closing keeping control. This routine is repeatedly executed by the control device 100 while the control device 100 is running.

As shown in FIG. 5, when starting this routine, in the process of step S300, the control device 100 first determines whether the fuel cut-off control is being implemented. When determining that the fuel cut-off control is being implemented (step S300: YES), the control device 100 advances the process to step S310.

In the process of step S310, the boost control unit 104 of the control device 100 starts the valve-closing keeping control. In the valve-closing keeping control, the boost control unit 104 closes the wastegate 60 and keeps the wastegate 60 closed. When determining that the fuel cut-off control is being executed, in a case where the valve-closing keeping control has already been implemented, the control device 100 continues the valve-closing keeping control without executing any process in the process of step S310.

When determining that the fuel cut-off control is not being executed (step S300: NO), the control device 100 ends this routine without executing the process of step S310. By repeatedly executing this routine while the internal combustion engine 10 is mining, the valve-closing keeping control is started from the point in time at which the fuel cut-off control is started.

Figure 6:
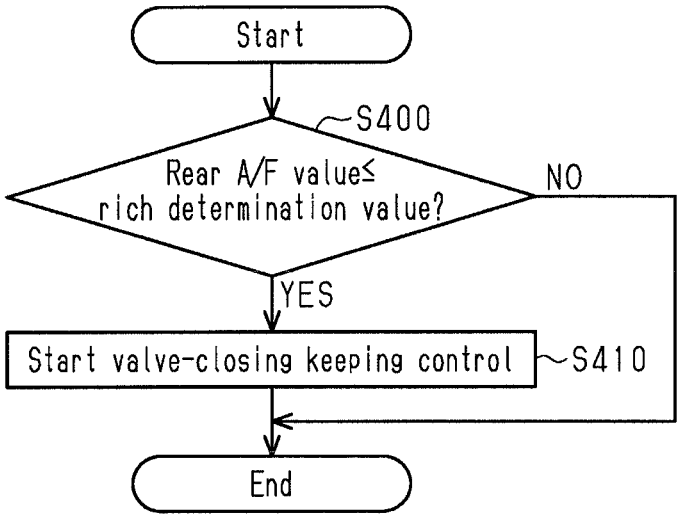
FIG. 6 is a flowchart illustrating the flow of processes in a routine for determining to end the valve-closing keeping control.

FIG. 6 illustrates the flow of processes in a routine for determining to end the valve-closing keeping control. This routine is repeatedly executed by the control device 100 while the valve-closing keeping control is being executed.

As shown in FIG. 6, when starting this routine, in the process of step S400, the control device 100 first determines whether the rear A/F value is less than or equal to the rich determination value. When determining that the rear A/F value is less than or equal to the rich determination value (step S400: YES), the control device 100 advances the process to step S410.

The control device 100 ends the valve-closing keeping control in the process of step S410. In the process of step S410, the boost control unit 104 of the control device 100 ends the valve-closing keeping control. Thus, the boost control unit 104 calculates the target open degree of the wastegate 60, for example, based on the vehicle speed and the accelerator operation amount or based on the engine rotation speed and the engine load factor to drive the actuator 61 and control the open degree of the wastegate 60.

Further, as shown in FIG. 6, when determining that the rear A/F value is greater than the rich determination value (step S400: NO), the control device 100 ends this routine without executing the process of step S410. That is, the boost control unit 104 ends the valve-closing keeping control on the condition that the downstream A/F sensor 35 has detected that the air-fuel ratio is richer than the stoichiometric air-fuel ratio after the engine operation was resumed by resuming the supply of fuel to the combustion chamber 11.

In this manner, when it can be estimated that the rear A/F value is greater than the rich determination value and unburned fuel is not contained in the exhaust gas flowing downstream of the catalyst device 80 although the valve-closing keeping control is being executed, the control device 100 does not end the valve-closing keeping control. In short, the condition for cancelling the valve-closing keeping control by the control device 100 is that the air-fuel ratio being richer than the stoichiometric air-fuel ratio has been detected by the downstream A/F sensor 35. In the control device 100, the valve-closing keeping control is continued until the fuel passes through the catalyst device 80 and reaches the downstream A/F sensor 35 without being completely consumed through a reduction reaction in the catalyst device 80 as a result of reducing oxygen absorbed by the catalyst device 80 through the rich reduction control.

Figure 7:
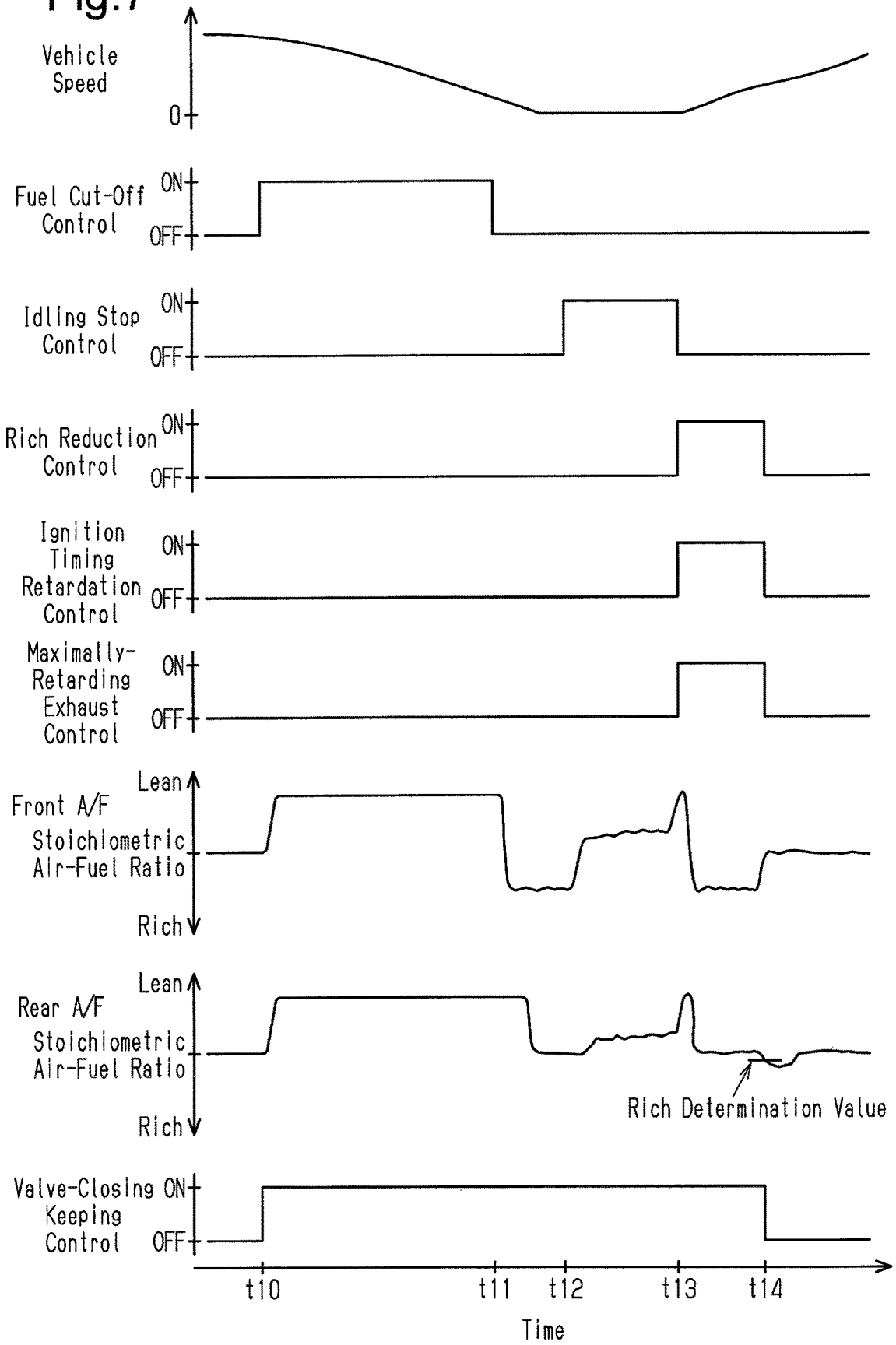
FIG. 7 is a timing diagram illustrating the relationship between the timings of executing controls.

Next, the operation of the first embodiment will be described with reference to FIG. 7. FIG. 7 is a timing diagram illustrating a change in each control that occurs when the vehicle decelerates to stop and then restarts.

As shown in FIG. 7, when the vehicle starts to decelerate, at the point in time t10, the fuel cut-off control is started (step S300: YES) and the valve-closing keeping control is started (step S310: YES) to keep the wastegate 60 closed. The execution of the fuel cut-off control stops the supply of fuel, thereby causing air to pass through the combustion chamber 11 and flow into the exhaust passage 19. Thus, a front A/F value, which is a detection value of the upstream A/F sensor 34, and the rear A/F value, which is a detection value of the downstream A/F sensor 35, both indicate that the front A/F value and the rear A/F value are lean. Air that does not contain fuel passes through the catalyst device 80. Thus, the catalyst device 80 absorbs oxygen.

At the point in time t11, when a decrease in the vehicle speed stops the fuel cut-off control and shifts to idling operation, the supply of fuel is resumed. Thus, the front A/F value and the rear A/F value both change to be richer than the stoichiometric air-fuel ratio. At the point in time t12, when the vehicle is stopped and the idling stop control is performed to stop the operation of the internal combustion engine 10, the supply of fuel stops. Then, the front A/F value and the rear A/F value both change to be approximate to the stoichiometric air-fuel ratio. While the internal combustion engine 10 is not operating in this manner, the catalyst device 80 is exposed to the air in the exhaust passage 19. Thus, the catalyst device 80 absorbs oxygen.

At the point in time t13, when the stopping of the operation by the idling stop control is cancelled to restart the internal combustion engine 10 (step S100: YES), the rich reduction control, the ignition timing retardation control, and the maximally-retarding exhaust control are started (step S110, step S120, and step S130). This causes fuel to be supplied with the air-fuel ratio increased to be richer than the stoichiometric air-fuel ratio, thereby introducing exhaust gas containing excess fuel into the catalyst device 80. Thus, the front A/F value becomes richer. Immediately after the rich reduction control is started, the fuel contained in exhaust gas is consumed by the reduction of oxygen absorbed by the catalyst device 80 and thus does not reach the downstream A/F sensor 35. Thus, the rear A/F value becomes approximate to the stoichiometric air-fuel ratio. When the rich reduction control continues, the reduction of oxygen progresses so that the absorption amount of oxygen in the catalyst device 80 decreases. Consequently, the fuel contained in the exhaust gas passes through the catalyst device 80 and reaches the downstream A/F sensor 35 without being completely consumed.

At the point in time t14, when the rear A/F value is less than or equal to the rich determination value (step S200: YES, step S400: YES), the rich reduction control ends (step S210) and the valve-closing keeping control also ends (step S410). At the same time, the ignition timing retardation control and the maximally-retarding exhaust control end (step S220 and step S230).

In the control device 100, the valve-closing keeping control is started from the point in time at which the fuel cut-off control is started. Thus, when the rich reduction control is started, the wastegate 60 is already kept closed. During the execution of the rich reduction control, the valve-closing keeping control continues and the wastegate is kept closed.

Further, during the execution of the rich reduction control, the ignition timing retardation control is executed to perform the engine operation with the ignition timing retarded. In addition, during the execution of the rich reduction control, the maximally-retarding exhaust control is executed to control the overlap with the timing of opening and closing the exhaust valve 24 set to be most retarded.

The advantages provided by the control device 100 of the first embodiment will now be described.

(1) In a case in which the wastegate 60 is kept closed, the gas flowing through the exhaust passage 19 passes through the turbine wheel 54 of the turbocharger 50. As the turbine wheel 54 rotates, the gas passing through the turbine wheel 54 and flowing toward the downstream side becomes a swirl flow and reaches the catalyst device 80. Thus, as long as the valve-closing keeping control is executed, when the engine operation is resumed to execute the rich reduction control, exhaust gas containing excess fuel passes through the turbine wheel 54 and the exhaust gas, which is the swirl flow, is introduced into the catalyst device 80. In this case, the exhaust gas is diffused in the exhaust passage 19 by a centrifugal force so that the exhaust gas containing fuel is uniformly introduced into the catalyst device 80 easily. Further, as compared to when exhaust gas flows straight toward the downstream side without swirling, the swirl flow can ensure the time for a catalyst and fuel to contact each other. Thus, the above-described configuration allows for efficient reduction of oxygen in the catalyst device 80 by the rich reduction control.

(2) The wastegate 60 is kept closed until the condition for cancelling the valve-closing keeping control has been satisfied by the engine operation that was performed after starting the valve-closing keeping control when the fuel cut-off control started and closing the wastegate 60 through the valve-closing keeping control. Thus, when the engine operation is resumed, the wastegate 60 is already closed. Accordingly, since exhaust gas passes through the turbine wheel 54 from when the rich reduction control is started, the operation resulting from the above-described swirl flow can be provided. Therefore, the above-described configuration expedites a reduction reaction in the catalyst device 80 with the swirl flow to immediately complete the reduction of an excessive amount of oxygen at the restarting time and quickly restore the purification ability.

(3) As long as the fuel cut-off control is executed, the output torque of the internal combustion engine 10 does not increase even if the wastegate 60 is closed. This allows the wastegate 60 to be kept closed in advance in preparation for the rich reduction control. In the above-described configuration, the valve-closing keeping control starts from the point in time at which the fuel cut-off control is started. Thus, the wastegate 60 can be kept closed in advance in preparation for the rich reduction control that is performed after the earliest point in time.

(4) When the fuel introduced together with exhaust gas by the rich reduction control is completely consumed through the reduction of oxygen absorbed by the catalyst device 80, exhaust gas that does not contain fuel reaches the downstream A/F sensor 35. When the reduction of oxygen progresses and the absorption amount of oxygen in the catalyst device 80 becomes small, fuel passes through the catalyst device 80 and reaches the downstream A/F sensor 35 without being completely consumed. The above-described configuration employs the configuration in which the valve-closing keeping control is ended on the condition that the air-fuel ratio being richer than the stoichiometric air-fuel ratio has been detected by the downstream A/F sensor 35. Thus, it is possible to check that the reduction of oxygen progresses until fuel becomes unable to be completely consumed based on the detection result of the downstream A/F sensor 35, thereby ending the valve-closing keeping control.

(5) Retarding the ignition timing limits the generation of NOx. In the above-described configuration, while the rich reduction control is incomplete, the ignition timing retardation control is executed to retard the ignition timing retardation control and limit the emission of NOx. This makes it possible to limit the emission of NOx until the purification ability of the catalyst device 80 restores.

(6) The emission of NOx and HC can be limited by causing exhaust gas to flow back into the combustion chamber 11 using the valve overlap. Like in the above-described configuration, when the maximally-retarding exhaust control to adjust the valve overlap is executed by adjusting the timing of opening the intake valve 23 with the timing of closing the exhaust valve 24 maximally retarded, the actual compression ratio can be reduced by maximally delaying the timing of closing the intake valve 23 while achieving the magnitude of a target valve overlap. Thus, the above-described configuration easily achieves the Atkinson cycle by delaying the timing of closing the intake valve 23 and achieves the target valve overlap. Thus, the pumping loss can be reduced using the Atkinson cycle to limit the consumption amount of fuel and limit the emission of NOx and HC.

The present embodiment may be modified as follows.

The valve-closing keeping control is started from the point in time at which the fuel cut-off control is started. Instead, the timing of starting the valve-closing keeping control does not have to be from the point in time at which the fuel cut-off control is started. The valve-closing keeping control simply needs to be started before the restarting is performed to start the rich reduction control. This allows for the advantage of uniformly introducing fuel into the catalyst device 80 using a swirl flow from the point in time at which the rich reduction control is started.

Second Embodiment

Subsequently, the control device 100 for the internal combustion engine 10, which is an onboard internal combustion engine, according to a second embodiment will be described with reference to FIGS. 8 to 10. The same reference numerals are given to those components that are common to the first embodiment, and detailed explanations are omitted. In the first embodiment, the valve-closing keeping control is started from the point time at which the fuel cut-off control is started. In the control device 100 of the second embodiment, the valve-closing keeping control is started before the fuel cut-off control is started, and the wastegate 60 is closed prior to the execution of the fuel cut-off control.

In the control device 100 of the second embodiment, in the same manner as the control device 100 of the first embodiment, the rich reduction control is executed through the processes described with reference to FIGS. 3 and 4. In the control device 100 of the first embodiment, the valve-closing keeping control is started when the fuel cut-off control is started through the routine described with reference to FIG. 5. In the control device 100 of the second embodiment, instead of the routine illustrated in FIG. 5, a routine illustrated in FIG. 8 is executed. The routine illustrated in FIG. 8 is repeatedly executed by the control device 100 while the control device 100 is running.

Figure 8:
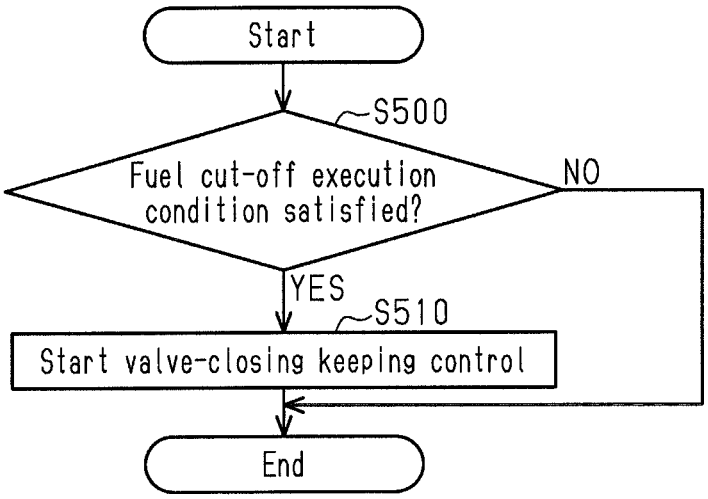
FIG. 8 is a flowchart illustrating the flow of processes in a routine for determining to start the valve-closing keeping control in a second embodiment.

As shown in FIG. 8, when starting this routine, in the process of step S500, the control device 100 first determines whether a fuel cut-off execution condition has been satisfied. The fuel cut-off execution condition is a requirement for executing the fuel cut-off control. The fuel cut-off execution condition is the condition of the logical conjunction of the operation amount of the accelerator being zero and the engine rotation speed being greater than or equal to a fuel cut-off permission rotation speed. When determining that the fuel cut-off execution condition has been satisfied (step S500: YES), the control device 100 advances the process to step S510.

In the process of step S510, the boost control unit 104 of the control device 100 starts the valve-closing keeping control. In the valve-closing keeping control, the boost control unit 104 closes the wastegate 60 and keeps the wastegate 60 closed. In the process of step S500, in a case where the valve-closing keeping control has already been implemented when determining that the fuel cut-off execution condition has been satisfied, the control device 100 continues the valve-closing keeping control without executing any process in the process of step S510.

When determining that the fuel cut-off execution condition has not been satisfied (step S500: NO), the control device 100 ends this routine without executing the process of step S510.

By repeatedly executing this routine while the internal combustion engine 10 is running, the valve-closing keeping control is started from the point in time at which the fuel cut-off execution condition is satisfied. In the control device 100 of the second embodiment, the timing of ending the valve-closing keeping control is determined through the routine described with reference to FIG. 6.

Next, the determination of the timing of starting the fuel cut-off control in the control device 100 of the second embodiment will be described with reference to FIG. 9. FIG. 9 illustrates the flow of processes in a routine for determining to start the fuel cut-off control in the control device 100 of the second embodiment. This routine is repeatedly executed by the control device 100 at predetermined cycles while the control device 100 is running.

Figure 9:
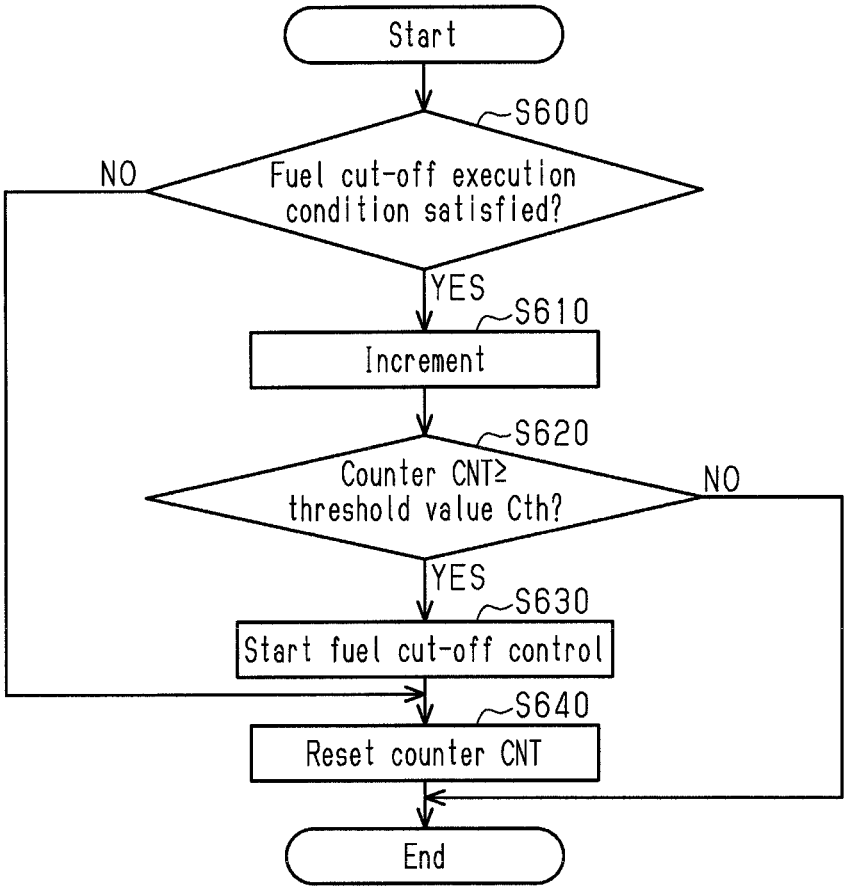
FIG. 9 is a flowchart illustrating the flow of processes in a routine for determining to start a fuel cut-off control.

As shown in FIG. 9, when starting this routine, in the process of step S600, in the same manner as the process of S500, the control device 100 first determines whether the fuel cut-off execution condition has been satisfied. When determining that the fuel cut-off execution condition has been satisfied (step S600: YES), the control device 100 advances the process to step S610.

The control device 100 increments a counter CNT in the process of step S610. The counter CNT is a counter for counting the time elapsed from when the fuel cut-off execution condition was satisfied. More specifically, the control device 100 increases the counter CNT one by one every time the control device 100 executes the process of step S610. Next, the control device 100 executes the process of step S620. In the process of step S620, the control device 100 determines whether the counter CNT is greater than or equal to a threshold value Cth. The threshold value Cth is set to a value that allows for determination based on the counter CNT having reached the threshold value Cth that the time from when the wastegate 60 started closing to when the wastegate 60 was completely closed has sufficiently elapsed after satisfying the fuel cut-off execution condition and starting the valve closing keeping control. That is, in step S610, based on the counter CNT being greater than or equal to the threshold value Cth, it is determined that the time for the wastegate 60 to be closed has sufficiently elapsed.

When determining that the counter CNT is greater than or equal to the threshold value Cth (step S620: YES), the control device 100 advances the process to step S630. In step S630, the injection control unit 101 of the control device 100 starts the fuel cut-off control. Then, the control device 100 resets the counter CNT to zero in the process of the subsequent step S640 and temporarily ends this routine. When determining that the counter CNT is less than the threshold value Cth (step S620: NO), the control device 100 temporarily ends this routine without executing the process of step S630 and the process of step S640.

When determining that the fuel cut-off execution condition has not been satisfied (step S600: NO), the control device 100 executes the process of step S640 without executing the processes of step S610 to step S630 and then resets the counter CNT to zero to temporarily end this routine.

More specifically, the control device 100 performs this routine to start the fuel cut-off control after a certain delay time TD has elapsed since the fuel cut-off execution condition was satisfied. The period during which the counter CNT reaches the threshold value Cth corresponds to the delay time TD. The length of the delay time TD is set to time enough to close the wastegate 60 after starting closing the wastegate 60 since the fuel cut-off execution condition was satisfied.

Next, the operation of the second embodiment will be described with reference to FIG. 10. FIG. 10 is a timing diagram showing a change in each control when the vehicle decelerates to stop. That is, FIG. 10 illustrates a state on and before the point in time t11 of FIG. 7. The change in each control subsequent to the point in time t11 is the same as that of the first embodiment, which has been described with reference to FIG. 7.

Figure 10:
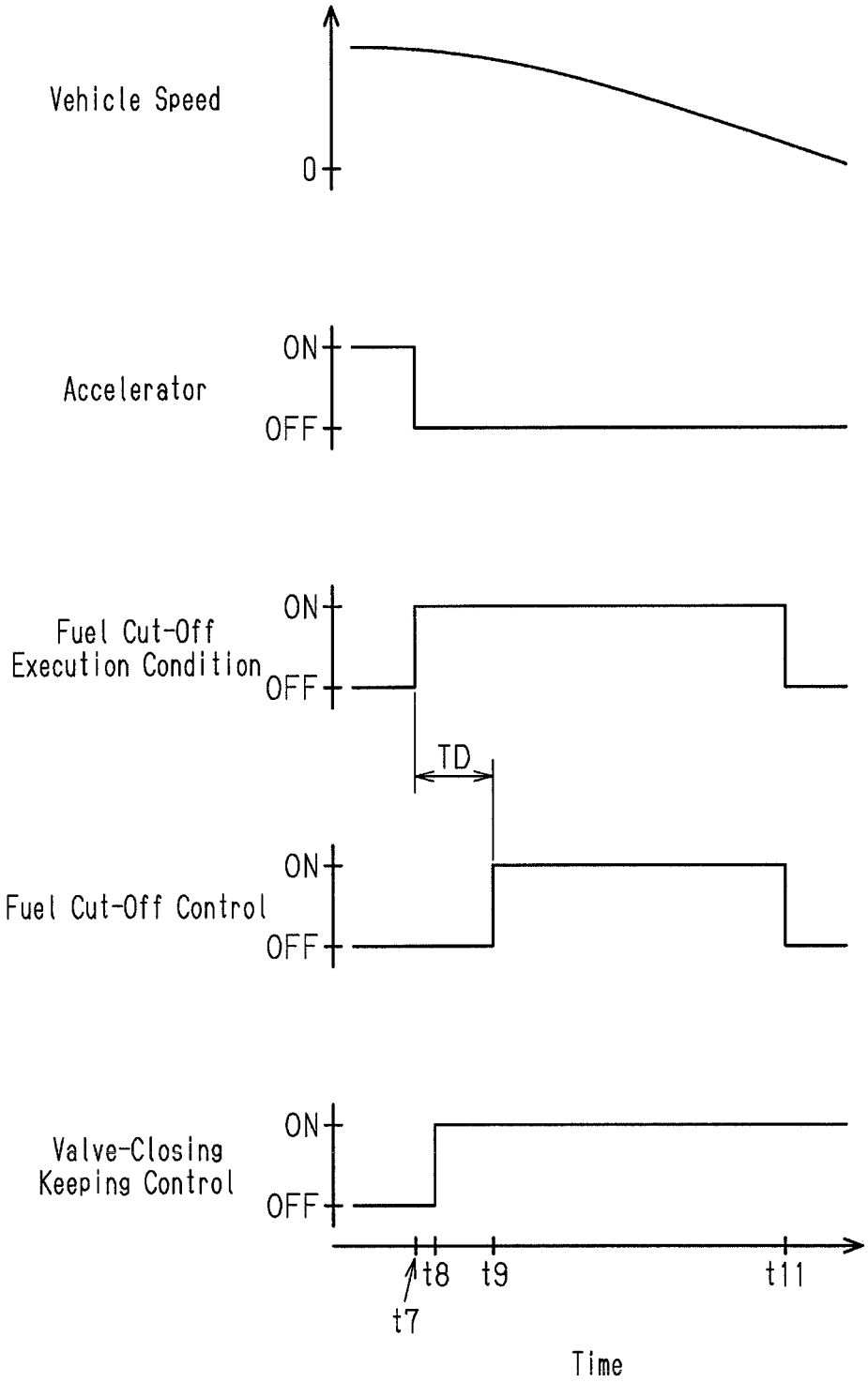
FIG. 10 is a timing diagram illustrating the relationship between the timing of executing the valve-closing keeping control and the timing of executing the fuel cut-off control.

As shown in FIG. 10, at the point in time t7, when the operation amount of the accelerator becomes zero, the fuel cut-off execution condition is satisfied. In FIG. 10, the accelerator is off when the operation amount of the accelerator is zero, and the accelerator is on when the accelerator is being operated.

When the fuel cut-off execution condition has been satisfied (step S500: YES, step S600: YES), at the point in time t8, the valve-closing keeping control is started (step S510) to close the wastegate 60. Further, while the fuel cut-off execution condition is satisfied, the counter CNT is repeatedly incremented (step S610).

At the point in time t9, when the counter CNT is determined as being greater than or equal to the threshold value Cth (step S620: YES), the fuel cut-off control is started (step S630). The execution of the fuel cut-off control stops the supply of fuel, thereby causing air to pass through the combustion chamber 11 and flow into the exhaust passage 19. Thus, as has been described with reference to FIG. 7, the front A/F value, which is a detection value of the upstream A/F sensor 34, and the rear A/F value, which is a detection value of the downstream A/F sensor 35, both indicate that the front A/F value and the rear A/F value are lean. Since air that does not contain fuel passes through the catalyst device 80, the catalyst device 80 absorbs oxygen.

At the point in time t11, when the engine rotation speed decreases to be less than the fuel cut-off permission rotation speed as the vehicle speed decreases, the fuel cut-off execution condition becomes unsatisfied. This stops the fuel cut-off control and shifts to idling operation. The shifting to the idling operation resumes the supply of fuel. Thus, the front A/F value and the rear A/F value both change to be richer than the stoichiometric air-fuel ratio.

The subsequent changes are the same as those in the first embodiment, which has been described with reference to FIG. 7.

More specifically, after the vehicle is stopped and the idling stop control is performed to stop the operation of the internal combustion engine 10, the stopping of the operation by the idling stop control is cancelled to restart the internal combustion engine 10 (step S100: YES). As a result, the rich reduction control, the ignition timing retardation control, and the maximally-retarding exhaust control are started (step S110, step S120, and step S130). This causes fuel to be supplied with the air-fuel ratio increased to be richer than the stoichiometric air-fuel ratio, thereby introducing exhaust gas containing excess fuel into the catalyst device 80. Thus, the front A/F value becomes richer. When the rich reduction control continues, the reduction of oxygen progresses so that the absorption amount of oxygen in the catalyst device 80 decreases. Consequently, the fuel contained in the exhaust gas passes through the catalyst device 80 and reaches the downstream A/F sensor 35 without being completely consumed.

When the rear A/F value is less than or equal to the rich determination value (step S200: YES, step S400: YES), the rich reduction control ends (step S210) and the valve-closing keeping control also ends (step S410). At the same time, the ignition timing retardation control and the maximally-retarding exhaust control end (step S220 and step S230). In the control device 100 of the second embodiment, the wastegate 60 is kept closed until the condition for cancelling the valve-closing keeping control is satisfied by the engine operation that was performed after closing the wastegate 60 through the valve-closing keeping control. Thus, when the engine operation is resumed, the wastegate 60 is already closed. Accordingly, since exhaust gas passes through the turbine wheel 54 from when the rich reduction control is started, the operation resulting from a swirl flow can be provided in the same manner as the first embodiment.

Further, during the execution of the rich reduction control, the ignition timing retardation control is executed to perform the engine operation with the ignition timing retarded. In addition, during the execution of the rich reduction control, the maximally-retarding exhaust control is executed to control the overlap with the timing of opening and closing the exhaust valve 24 set to be most retarded.

During the execution of the fuel cut-off control, the supply of fuel to the combustion chamber 11 is not performed. Thus, although burning is not performed, intake and exhaust are performed with the intake air amount limited. Thus, the inside of the combustion chamber 11 is under negative pressure. Further, by closing the wastegate 60 during the execution of the fuel cut-off control, the open degree of the wastegate 60 decreases. When the wastegate 60 approaches a seat surface, the wastegate 60 is easily vibrated by the negative pressure in the combustion chamber 11 and the pulsation of exhaust gas. Thus, when the wastegate 60 strikes the seat surface while vibrating, noise is generated. Since burning is not performed during the execution of the fuel cut-off control, noise or vibration resulting from burning does not occur. Thus, the noise produced by the wastegate 60 striking the seat surface is noticeable.

In the control device 100 of the second embodiment, when the condition for executing the fuel cut-off control is satisfied, the boost control unit 104 starts the valve-closing keeping control to close the wastegate 60 at the point in time t8 prior to the execution of the fuel cut-off control at the point in time t9.

In this configuration, prior to the execution of the fuel cut-off control, the wastegate 60 is closed to start the fuel cut-off control with the wastegate 60 closed.

The control device 100 of the second embodiment provides the following advantage in addition to the advantages that are the same as advantages (1), (2), and (4) to (6) of the first embodiment.

(7) In the second embodiment, the wastegate 60 is closed when burning is performed in the internal combustion engine 10 to limit the vibration of the wastegate 60 and make the noise produced by the wastegate 60 striking the seat surface unnoticeable. This makes it difficult for the occupant to hear the noise produced by the wastegate 60 striking the seat surface.

The second embodiment may be modified as follows.

In the above-described example, the elapse of the delay time TD is determined using the counter CNT. However, the fuel cut-off control does not have to be started by determining the elapse of the delay time TD. The fuel cut-off control may be started after checking with a different means that the wastegate 60 is closed. For example, the fuel cut-off control may be executed by determining that the wastegate 60 is closed based on the fact that the actuator 61 has stopped operating since the actuator 61 started closing the wastegate 60.

The following are modifications commonly applicable to each of the above-described embodiments. The above-described embodiments, the above-described modifications, and the following modifications can be combined as long as the combined modifications remain technically consistent with each other.

In the above-described example, the A/F sensor in which the output value continuously changes in accordance with a change in the level of the oxygen concentration is employed as the air-fuel ratio sensor in the internal combustion engine. However, the air-fuel ratio sensor that detects the air-fuel ratio is not limited to the A/F sensor. For example, an $O_2$ sensor may be used. The $O_2$ sensor outputs an output value indicating that the air-fuel ratio is rich when the air-fuel ratio becomes rich when the output value greatly changes over the stoichiometric air-fuel ratio and outputs an output value indicating that the air-fuel ratio is lean when the air-fuel ratio becomes lean when the output value greatly changes over the stoichiometric air-fuel ratio.

The condition for ending the valve-closing keeping control is not limited to a condition in which the air-fuel ratio being richer than the stoichiometric air-fuel ratio has been detected by the air-fuel ratio sensor. Instead, for example, the condition for cancelling the valve-closing keeping control may be that the rich reduction control executed together with the valve-closing keeping control has continued for a certain period.

The timing of ending the rich reduction control, the ignition timing retardation control, the maximally-retarding exhaust control, and the valve-closing keeping control does not have to be the same as the condition for cancelling these controls. Instead, for example, the rich reduction control may be ended prior to the valve-closing keeping control. Alternatively, the valve-closing keeping control may be ended prior to the rich reduction control. If there is a period during which the rich reduction control is executed together with the valve-closing keeping control, fuel can be uniformly introduced into the catalyst device 80 using a swirl flow during that period.

In the above-described example, the rich reduction control is executed at the restarting time by the idling stop control. Instead, the rich reduction control may be executed when the fuel cut-off control is ended to resume the supply of fuel. Since oxygen is absorbed by the catalyst device 80 during the execution of the fuel cut-off control, the absorption amount of oxygen may become excessive. Also, when the fuel cut-off control is ended to resume the supply of fuel, fuel can be uniformly introduced into the catalyst device 80 using a swirl flow by executing the valve-closing keeping control in the same manner as the above-described embodiments.

The same configuration as that of the control device of each of the above-described embodiments may be applied to an internal combustion engine including two or more catalyst devices located in the exhaust passage 19. When two catalyst devices are arranged, the rich reduction control may be continued until the reduction of oxygen has been completed in the downstream catalyst device. The operation resulting from a swirl flow generated by the valve-closing keeping control affects the catalyst device located on the most upstream side, which is most proximate to the turbine wheel 54, but hardly affects the downstream catalyst device. Thus, in this case, the valve-closing keeping control may be ended at the point in time at which the reduction of oxygen has been completed in the upstream catalyst device.

The control device 100 is not limited to one that performs software processing on all processes executed by itself. For example, the control device 100 may include at least part of the processes executed by the software in the present embodiment as one that is executed by hardware circuits dedicated to execution of these processes (such as ASIC). That is, the control device 100 may be modified as long as it has any one of the following configurations (a) to (c): (a) a configuration including a processor that executes all of the above-described processes according to programs and a program storage device such as a ROM that stores the programs; (b) a configuration including a processor and a program storage device that execute part of the above-described processes according to the programs and a dedicated hardware circuit that executes the remaining processes; and (c) a configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A control device for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control device comprises:

an injection control unit that controls the fuel injection valve and performs a fuel cut-off control to stop supply of fuel to a combustion chamber during deceleration;

an ignition control unit that controls the ignition device;

an idling stop control unit that executes an idling stop control to discontinue idling operation by automatically stopping and restarting engine operation; and a boost control unit that controls opening and closing of the wastegate, the injection control unit is configured to execute a rich reduction control that makes an air-fuel ratio richer than a stoichiometric air-fuel ratio when the engine operation has been resumed by resuming the supply of the fuel to the combustion chamber, and the boost control unit is configured to execute a valve-closing keeping control that keeps the wastegate closed until a condition for cancelling the valve-closing keeping control has been satisfied by the engine operation that was performed after closing the wastegate during execution of the fuel cut-off control.

2. The control device according to claim 1, wherein the boost control unit is configured to close the wastegate by starting the valve-closing keeping control at a point in time at which the fuel cut-off control is started.

3. A control device for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control device comprises circuitry that includes an injection control unit that controls the fuel injection valve and performs a fuel cut-off control to stop supply of fuel to a combustion chamber during deceleration, an ignition control unit that controls the ignition device, an idling stop control unit that executes an idling stop control to discontinue idling operation by automatically stopping and restarting engine operation, and a boost control unit that controls opening and closing of the wastegate, the injection control unit is configured to execute a rich reduction control that makes an air-fuel ratio richer than a stoichiometric air-fuel ratio when the engine operation has been resumed by resuming the supply of the fuel to the combustion chamber, and the boost control unit is configured to execute a valve-closing keeping control that keeps the wastegate closed until a condition for cancelling the valve-closing keeping control has been satisfied by the engine operation that was performed after closing the wastegate during execution of the fuel cut-off control.

4. A control device for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control device comprises:

an injection control unit that controls the fuel injection valve and performs a fuel cut-off control to stop supply of fuel to a combustion chamber during deceleration;

an ignition control unit that controls the ignition device;

an idling stop control unit that executes an idling stop control to discontinue idling operation by automatically stopping and restarting engine operation; and a boost control unit that controls opening and closing of the wastegate, the injection control unit is configured to execute a rich reduction control that makes an air-fuel ratio richer than a stoichiometric air-fuel ratio when the engine operation has been resumed by resuming the supply of the fuel to the combustion chamber, and the boost control unit is configured to execute a valve-closing keeping control that keeps the wastegate closed until a condition for cancelling the valve-closing keeping control has been satisfied by the engine operation that was performed after closing the wastegate prior to execution of the fuel cut-off control when a condition for executing the fuel cut-off control was satisfied.

5. The control device according to claim 1, wherein the onboard internal combustion engine further includes an air-fuel ratio sensor located downstream of the catalyst device, and the boost control unit is configured to end the valve-closing keeping control on the condition that the air-fuel ratio being richer than the stoichiometric air-fuel ratio has been detected by the air-fuel ratio sensor after the supply of the fuel to the combustion chamber was resumed to resume the engine operation.

6. The control device according to claim 1, wherein the ignition control unit is configured to execute an ignition timing retardation control that retards an ignition timing during execution of the rich reduction control.

7. The control device according to claim 1, wherein the onboard internal combustion engine further includes an intake-side variable valve timing mechanism that varies a timing of opening and closing an intake valve, and an exhaust-side variable valve timing mechanism that varies a timing of opening and closing an exhaust valve, the control device further comprises a valve timing control unit that controls the intake-side variable valve timing mechanism and the exhaust-side variable valve timing mechanism, and the valve timing control unit is configured to execute a maximally-retarding exhaust control that controls a valve overlap by adjusting a timing of opening the intake valve by the intake-side variable valve timing mechanism in a state in which a timing of closing the exhaust valve is maximally retarded by the exhaust-side variable valve timing mechanism during execution of the rich reduction control, the valve overlap referring to a period during which the exhaust valve and the intake valve are both open.

8. A control device for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control device comprises circuitry that includes an injection control unit that controls the fuel injection valve and performs a fuel cut-off control to stop supply of fuel to a combustion chamber during deceleration, an ignition control unit that controls the ignition device, an idling stop control unit that executes an idling stop control to discontinue idling operation by automatically stopping and restarting engine operation, and a boost control unit that controls opening and closing of the wastegate, the injection control unit is configured to execute a rich reduction control that makes an air-fuel ratio richer than a stoichiometric air-fuel ratio when the engine operation has been resumed by resuming the supply of the fuel to the combustion chamber, and the boost control unit is configured to execute a valve-closing keeping control that keeps the wastegate closed until a condition for cancelling the valve-closing keeping control has been satisfied by the engine operation that was performed after closing the wastegate prior to execution of the fuel cut-off control when a condition for executing the fuel cut-off control was satisfied.

9. A control method for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control method comprises:

controlling the fuel injection valve and performing a fuel cut-off control to stop supply of fuel to a combustion chamber during deceleration;

controlling the ignition device;

executing an idling stop control to discontinue idling operation by automatically stopping and restarting engine operation;

controlling opening and closing of the wastegate;

executing a rich reduction control that makes an air-fuel ratio richer than a stoichiometric air-fuel ratio when the engine operation has been resumed by resuming the supply of the fuel to the combustion chamber; and executing a valve-closing keeping control that keeps the wastegate closed until a condition for cancelling the valve-closing keeping control has been satisfied by the engine operation that was performed after closing the wastegate during execution of the fuel cut-off control.

10. A control method for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control method comprises:

controlling the fuel injection valve and performing a fuel cut-off control to stop supply of fuel to a combustion chamber during deceleration;

controlling the ignition device;

executing an idling stop control to discontinue idling operation by automatically stopping and restarting engine operation;

controlling opening and closing of the wastegate;

executing a rich reduction control that makes an air-fuel ratio richer than a stoichiometric air-fuel ratio when the engine operation has been resumed by resuming the supply of the fuel to the combustion chamber; and executing a valve-closing keeping control that keeps the wastegate closed until a condition for cancelling the valve-closing keeping control has been satisfied by the engine operation that was performed after closing the wastegate prior to execution of the fuel cut-off control when a condition for executing the fuel cut-off control was satisfied.

11. A control device for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control device comprises:

an injection control unit that controls the fuel injection valve;

an ignition control unit that controls the ignition device;

an idling stop control unit that executes an idling stop control to discontinue idling operation by automatically stopping and restarting engine operation; and a boost control unit that controls opening and closing of the wastegate, the injection control unit is configured to execute a rich reduction control that makes an air-fuel ratio richer than a stoichiometric air-fuel ratio when the engine operation has been resumed by resuming the supply of the fuel to the combustion chamber, and the boost control unit is configured to execute a valve-closing keeping control that closes the wastegate when the idling stop control unit stops the supply of the fuel or before the idling stop control unit stops the supply of the fuel in a case in which a condition for executing the idling stop control is satisfied and keeps the wastegate closed until a condition for cancelling the valve-closing keeping control has been satisfied by the restarted engine operation.

12. A control device for an onboard internal combustion engine, wherein the onboard internal combustion engine includes a fuel injection valve, an ignition device, a turbocharger equipped with a wastegate that controls a boost pressure by opening and closing a wastegate port, and a catalyst device arranged downstream of a turbine housing of the turbocharger in an exhaust passage, the catalyst device having an oxygen absorption ability and purifying exhaust gas, the control device comprises:

an injection control unit that controls the fuel injection valve and performs a fuel cut-off control to stop supply of fuel to a combustion chamber during deceleration;

an ignition control unit that controls the ignition device; and a boost control unit that controls opening and closing of the wastegate, the injection control unit is configured to execute a rich reduction control that makes an air-fuel ratio richer than a stoichiometric air-fuel ratio when the engine operation has been resumed by resuming the supply of the fuel to the combustion chamber, and the boost control unit is configured to execute a valve-closing keeping control that closes the wastegate during execution of the fuel cut-off control or prior to the execution of the fuel cut-off control when a condition for executing the fuel cut-off control is satisfied and keeps the wastegate closed until a condition for cancelling the valve-closing keeping control has been satisfied after the fuel cut-off control was ended to resume the supply of the fuel.

* * * * *